US007188927B2

(12) United States Patent
Anderson, Jr. et al.

(10) Patent No.: US 7,188,927 B2
(45) Date of Patent: Mar. 13, 2007

(54) PRINTHEAD WIPER CLEANING MECHANISM FOR AN IMAGING APPARATUS

(75) Inventors: James Daniel Anderson, Jr., Harrodsburg, KY (US); Martin Alan Johnson, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 275 days.

(21) Appl. No.: 10/944,013

(22) Filed: Sep. 16, 2004

(65) Prior Publication Data

US 2006/0055729 A1 Mar. 16, 2006

(51) Int. Cl.
*B41J 2/165* (2006.01)

(52) U.S. Cl. ..... 347/33; 347/29; 347/32

(58) Field of Classification Search ..... 347/29, 347/32, 33

See application file for complete search history.

(56) References Cited

U.S. PATENT DOCUMENTS 5,155,497 A 10/1992 Martin et al.
5,614,930 A 3/1997 Osborne et al.
5,798,775 A * 8/1998 Takahashi et al. ..... 347/33
5,896,145 A 4/1999 Osborne et al.
6,145,958 A 11/2000 Medin et al.
6,189,999 B1 2/2001 Pham et al.
6,340,218 B1 1/2002 Gaylor
6,655,781 B2 12/2003 Nakagawa et al.
6,698,864 B2 3/2004 Therien
6,739,696 B2 * 5/2004 Arai et al. ..... 347/33
2002/0140766 A1 10/2002 Niederhausern et al.

* cited by examiner

*Primary Examiner*—Shih-Wen Hsieh
(74) *Attorney, Agent, or Firm*—Taylor & Aust

(57) ABSTRACT

An imaging apparatus includes a maintenance station mounting a printhead wiper having a waste ink collection surface. A printhead carrier carries a printhead and a printhead wiper cleaning mechanism for cleaning the printhead wiper. The printhead wiper cleaning mechanism includes a hook member for contacting the waste ink collection surface of the printhead wiper for removing residual waste ink from the waste ink accumulation surface as the printhead wiper cleaning mechanism moves relative to the printhead wiper.

19 Claims, 3 Drawing Sheets

PRINTHEAD WIPER CLEANING MECHANISM FOR AN IMAGING APPARATUS

BACKGROUND OF THE INVENTION

1. Field of the Invention

The present invention relates to performing printhead maintenance in an imaging apparatus, and more particularly, to a printhead wiper cleaning mechanism for an imaging apparatus.

2. Description of the Related Art

An imaging apparatus, such as an ink jet printer, includes a maintenance station that performs maintenance operations to preserve the life of the associated printhead. For example, an ink jet printer includes an ink jet printhead having a plurality of ink jetting nozzles formed in a nozzle plate. The ink jet printhead may be attached, for example, to a printhead cartridge having an integral ink reservoir.

Such a maintenance station for an ink jet printer includes a printhead wiper and a printhead capping mechanism. The printhead wiper is typically an elongated rubber device having a sharp wiping edge that is used for wiping residual ink from the nozzles of the ink jet printhead nozzle plate. The capping mechanism is used to cap the ink jet printhead for storage. The wiping and capping operations prevent the nozzles from becoming blocked with contaminants, such as dried ink and accumulated paper dust, thereby extending the life of the ink jet printhead.

Some ink jet printers accumulate a considerable amount of excess ink on the nozzle plate, particularly when printing at a high duty cycle. During printhead wiping maintenance, the printhead wiper is positioned to engage the excess ink on the nozzle plate, with most of the removed waste ink staying on the printhead wiper following the wiping operation. However, if the printhead wiper cannot hold all of the removed waste ink, then some of the waste ink may be deposited onto the side of the printhead. These occurrences can cause degradation in the wiping performance of the printhead wiper, since the waste ink remaining on the printhead wiper may be reapplied to the nozzle plate, or catapulted by the printhead wiper onto the sheet of print media when the printhead disengages from the printhead wiper. Also, some of the waste ink on the side of the printhead may fall onto the sheet of print media during a printjob.

In addition, some imaging apparatus include a printhead carrier having mounted thereto a semi-permanent printhead containing multiple nozzle plates. In such a configuration, there is not any excess space for the waste ink to be wiped onto a side surface, as may be the case for a printhead cartridge having a single printhead nozzle plate.

What is needed in the art is a printhead wiper cleaning mechanism for an imaging apparatus.

SUMMARY OF THE INVENTION

The present invention provides a printhead wiper cleaning mechanism for an imaging apparatus.

The invention, in one form thereof, relates to an imaging apparatus. The imaging apparatus includes a maintenance station mounting a printhead wiper having a waste ink collection surface. A printhead carrier carries a printhead and a printhead wiper cleaning mechanism for cleaning the printhead wiper. The printhead wiper cleaning mechanism includes a hook member for contacting the waste ink collection surface of the printhead wiper for removing residual waste ink from the waste ink accumulation surface as the printhead wiper cleaning mechanism moves relative to the printhead wiper.

The invention, in another form thereof, relates to a printhead cartridge, including a body, at least one printhead coupled to the body, and at least one printhead wiper cleaning blade coupled to the body.

In another form thereof, the invention relates to a printhead assembly, including a base, at least one printhead coupled to the base, and at least one printhead wiper cleaning blade coupled to the base.

An advantage of the present invention is that the printhead wiper may be cleaned, whereby reducing the chances of waste ink removed from a printhead from coming into contact with the sheet of print media.

BRIEF DESCRIPTION OF THE DRAWINGS

The above-mentioned and other features and advantages of this invention, and the manner of attaining them, will become more apparent and the invention will be better understood by reference to the following description of exemplary embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
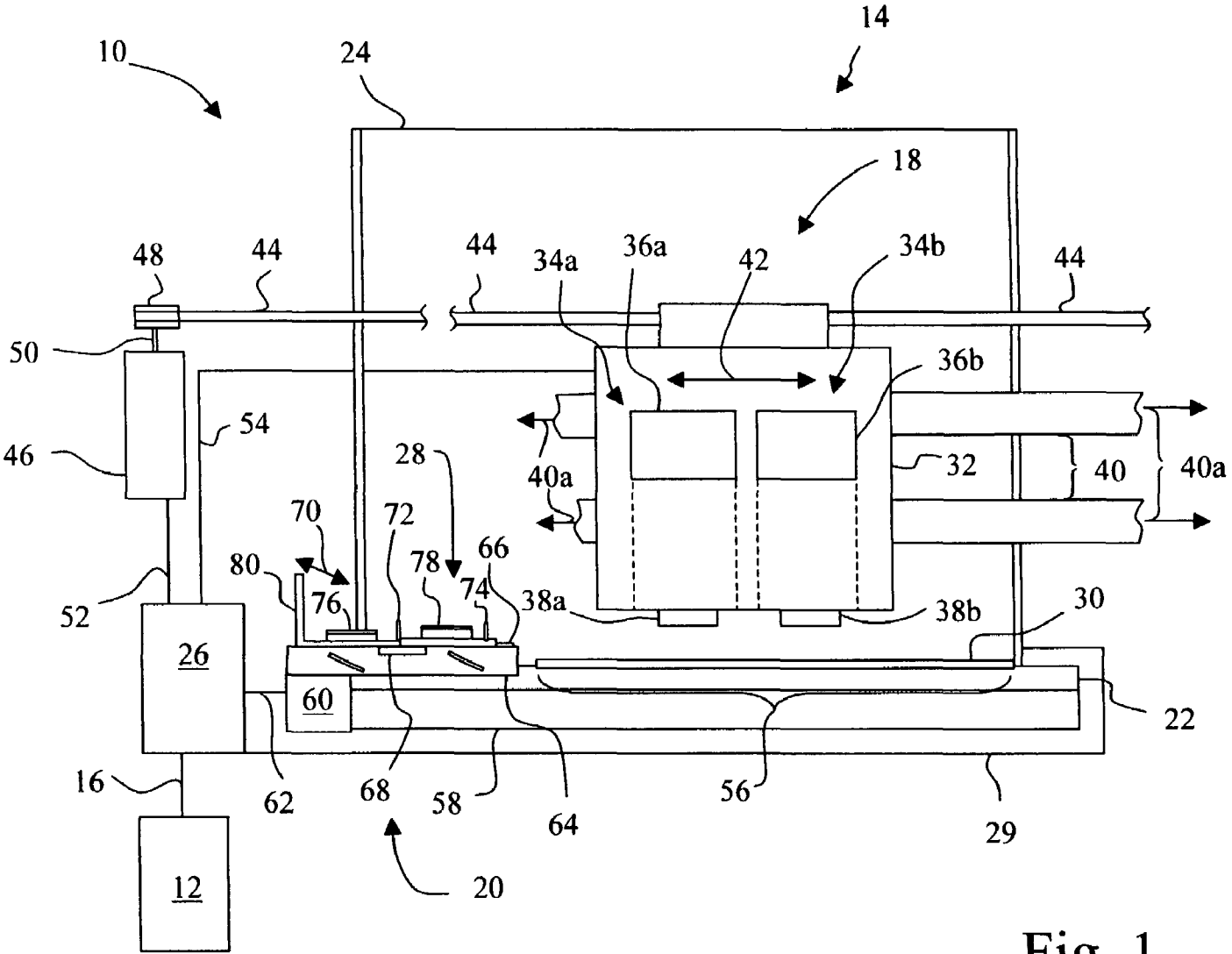
FIG. 1 is a diagrammatic representation of an imaging system employing an embodiment of the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of an ink jet printer, as shown. Thus, for example, imaging apparatus 14 may be a conventional ink jet printer, or may form the print engine for a multi-function apparatus, such as for example, a standalone unit that has faxing and copying capability, in addition to printing.

Host 12, which may be optional, may be communicatively coupled to imaging apparatus 14 via a communications link 16. As used herein, the term "communications link" is used to generally refer to structure that facilitates electronic communication between two components, and may operate using wired or wireless technology. Thus, communications link 16 may be, for example, a direct electrical connection, a wireless connection, or a network connection.

In embodiments including host 12, host 12 may be, for example, a personal computer including a display device, an input device (e.g., keyboard), a processor, input/output (I/O)

interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

Imaging apparatus 14, in the form of an ink jet printer, includes a printhead carrier system 18, a feed roller unit 20, a mid-frame 22, a media source 24, a controller 26 and a maintenance station 28. Printhead carrier system 18, feed roller unit 20, mid-frame 22, media source 24, controller 26 and maintenance station 28 may be mounted to an imaging apparatus frame 29.

Media source 24 is configured and arranged to supply from a stack of print media a sheet of print media 30 to feed roller unit 20, which in turn further transports the sheet of print media 30 during a printing operation.

Printhead carrier system 18 includes a printhead carrier 32 that carries, for example, one or more printhead cartridges, such as a monochrome printhead cartridge 34*a* and/or a color printhead cartridge 34*b*, which is removably attached thereto. Monochrome printhead cartridge 34*a* includes a monochrome ink reservoir 36*a* provided in fluid communication with a monochrome ink jet printhead 38*a*. Color printhead cartridge 34*b* includes a color ink reservoir 36*b* provided in fluid communication with a color ink jet printhead 38*b*. Alternatively, ink reservoirs 36*a*, 36*b* may be located off-carrier, and coupled to respective ink jet printheads 38*a*, 38*b* via respective fluid conduits. Also, alternatively, monochrome printhead cartridge 34*a* may be replaced with another color printhead cartridge, such as for example, a photo printhead cartridge.

Printhead carrier 32 is guided by a pair of guide members 40. Either, or both, of guide members 40 may be, for example, a guide rod, or a guide tab formed integral with imaging apparatus frame 29. The axes 40*a* of guide members 40 define a bi-directional scanning path 42 of printhead carrier 32. Printhead carrier 32 is connected to a carrier transport belt 44 that is driven by a carrier motor 46 via a carrier pulley 48. In this manner, carrier motor 46 is drivably coupled to printhead carrier 32, although one skilled in the art will recognize that other drive coupling arrangements could be substituted for the example given, such as for example, a worm gear drive. Carrier motor 46 can be, for example, a direct current motor or a stepper motor. Carrier motor 46 has a rotating motor shaft 50 that is attached to carrier pulley 48. Carrier motor 46 is coupled to controller 26 via a communications link 52. At a directive of controller 26, printhead carrier 32 is transported in a controlled manner along bi-directional scanning path 42, via the rotation of carrier pulley 48 imparted by carrier motor 46.

Ink jet printheads 38*a*, 38*b* are electrically connected to controller 26 via a communications link 54. Controller 26 supplies electrical address and control signals to imaging apparatus 14, and in particular, to the ink jetting actuators of ink jet printheads 38*a*, 38*b*, to effect the selective ejection of ink from ink jet printheads 38*a*, 38*b*.

During a printing operation, printhead carrier 32 transports ink jet printheads 38*a*, 38*b* across the sheet of print media 30 in a reciprocating manner along bi-directional scanning path 42, i.e., a scanning direction, to define a print zone 56 of imaging apparatus 14. Bi-directional scanning path 42, which is parallel with axes 40*a* of guide members 40, also may be referred to as main scan path 42 of printhead carrier 32. The sheet of print media 30 is transported in an incremental fashion through print zone 56 by the rotation of a feed roller 58 of feed roller unit 20. The rotation of feed roller 58 is effected by a drive unit 60. Drive unit 60 is electrically connected to controller 26 via a communications link 62.

Maintenance station 28 is provided for performing printhead maintenance operations on the ink jet nozzles of ink jet printheads 38*a*, 38*b*. Such operations may include, for example, a printhead spit maintenance operation, a printhead wiping operation and a printhead maintenance capping operation. Other services, such as for example, printhead priming and suction, may also be performed if desired by the inclusion of a vacuum device (not shown) of the type well known in the art. In order to conduct printhead maintenance operations, controller 26 controls the movement of printhead carrier 32 to position printhead carrier 32 in relation to maintenance station 28.

Maintenance station 28 includes a maintenance housing 64, a movable maintenance sled 66, and a sled latch mechanism 68. Maintenance housing 64 supports movable maintenance sled 66. Maintenance sled 66 is configured for movement in the directions generally depicted by double-headed arrow 70. The directions generally depicted by double-headed arrow 70 include both horizontal and vertical components. Mounted to maintenance sled 66 are a printhead wiper 72, a printhead wiper 74, a printhead cap 76 and a printhead cap 78. In this embodiment, printhead wiper 72 and printhead cap 76 will interact with printhead 38*a*, and printhead wiper 74 and printhead cap 78 will interact with printhead 38*b*.

Sled latch mechanism 68 is pivotably mounted to maintenance sled 66. Sled latch mechanism 68 cooperates with maintenance housing 64 and maintenance sled 66 to releasably latch maintenance sled 66 at a predefined elevation, such as for example, at an intermediate, or wiping, elevation.

Maintenance sled 66 includes a carrier engagement member 80. Maintenance sled 66 is biased by a biasing spring (not shown) in a direction toward printhead carrier 32. The spring force exerted by the biasing spring is sufficient to accelerate maintenance sled 66 and its associated components to the lowered (resting) position so that they are clear of printhead carrier 32 and ink jet printheads 38*a*, 38*b* as printhead carrier 32 returns to print zone 56.

With the orientation of components as shown in FIG. 1, a leftward movement of printhead carrier 32 causes printhead carrier 32 to engage carrier engagement member 80, thereby causing maintenance sled 66 to move to the left and upward, as illustrated by arrow 70, progressing from a lowered, or rest, elevation to the wiping elevation, and then progressing from the wiping elevation to the full raised, or capping, elevation. A rightward movement of printhead carrier 32 causes maintenance sled 66 to lower from the capping elevation to the wiping elevation, and maintenance sled 66 is temporarily held at the wiping elevation by sled latch mechanism 68. While at the wiping elevation, the printhead wipers 72, 74 remain stationary except for their deflection during the wiping of their respective printheads 38*a*, 38*b* as printhead carrier 32 continues its rightward movement. Following the wiping of printheads 38*a*, 38*b*, printhead carrier 32 unlatches sled latch mechanism 68, and maintenance sled 66, and in turn printhead wipers 72, 74, are lowered to the lowered position.

Figure 2:
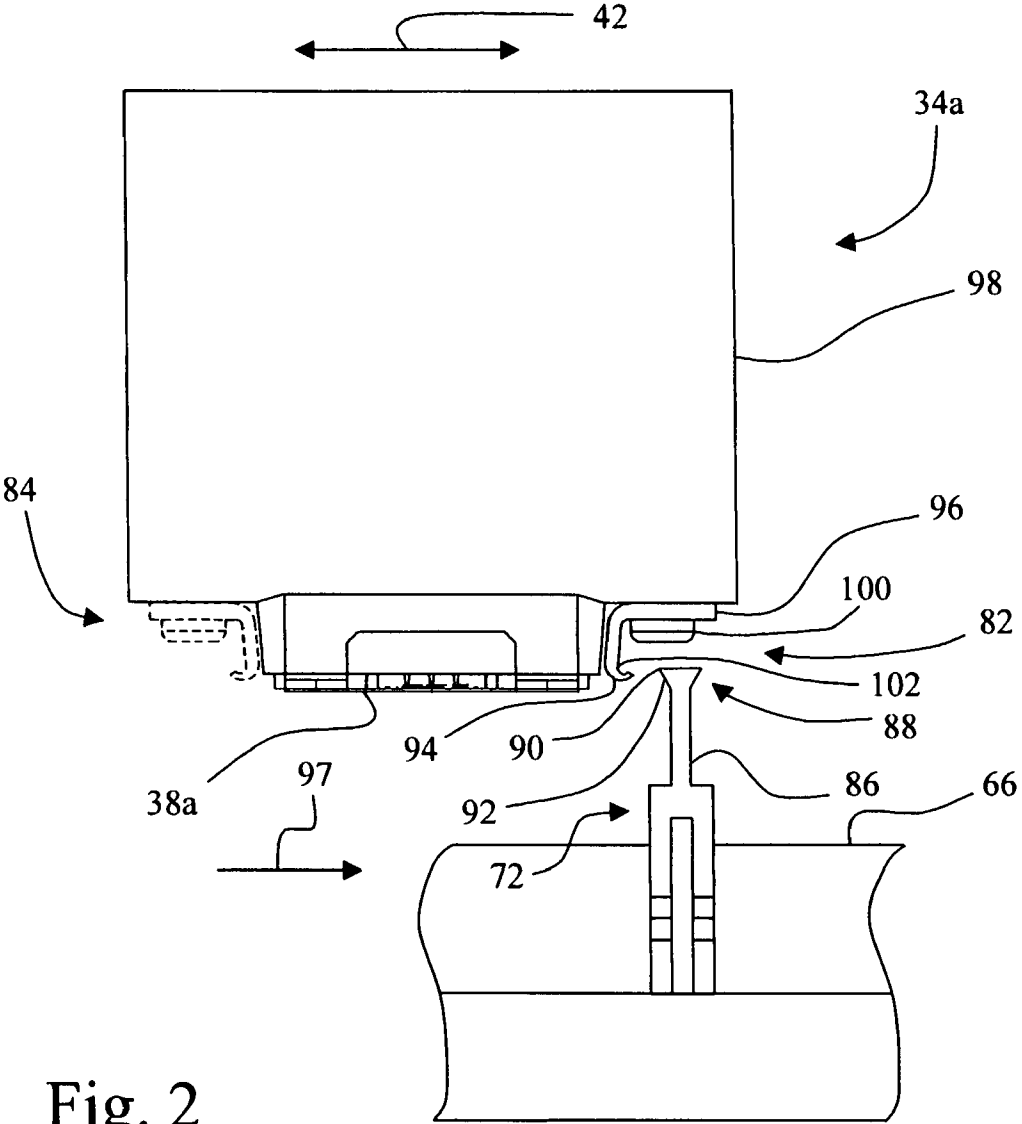
FIG. 2 is an enlarged front view of a printhead cartridge including a printhead wiper cleaning mechanism in accordance with one embodiment of the present invention.

Referring now also to FIG. 2, each of printhead cartridges 34*a*, 34*b* will include a printhead wiper cleaning mechanism, such as for example, a printhead wiper cleaning mechanism 82. Optionally, a second printhead wiper cleaning mechanism 84 may be added. While printhead cartridge 34*a* is used for purposes of this example, it is to be understood that the principles of the present invention that are described with respect to printhead cartridge 34*a* would also apply to printhead cartridge 34*b*.

FIG. 2 shows printhead cartridge 34*a* and a portion of maintenance sled 66, with maintenance sled 66 and printhead wiper 72 being in the wiping elevation prior to performing a printhead wiping function with respect to printhead 38*a*. Printhead wiper 72 includes an elongate body 86 and wiper head 88 attached to elongate body 86. Printhead wiper 72 may be formed as an integral device made from an elastomeric material, such as rubber. Wiper head 88 includes a wiping edge 90, and a waste ink collection surface 92 adjacent wiping edge 90.

Printhead wiper cleaning mechanism 82 includes a hook member 94 and a base 96, from which hook member 94 extends. Hook member 94 is positioned for contacting waste ink collection surface 92 and wiping edge 90 of printhead wiper 72 for removing residual waste ink from waste ink collection surface 92 as printhead wiper cleaning mechanism 82 moves in a direction 97 relative to printhead wiper 72 along the bi-directional scanning path 42, i.e., the main scan path, prior to printhead wiper 72 contacting printhead 38*a*. As such, printhead wiper cleaning mechanism 82 is positioned on one side of printhead 38*a* in direction 97 of main scan path 42. The width of hook member 94 may be at least as wide as the width of wiper head 88 of printhead wiper 72 in a direction perpendicular to direction 97. Hook member 94 may be formed, for example, as a curved printhead wiper cleaning blade, and may be made from a rigid material, such as plastic. Hook member 94 may be attached to a body 98 of printhead cartridge 34*a* by a fastener 100, or may be attached by integral formation with body 98. Hook member 94 may include an arc-shaped surface 102 that faces outwardly from printhead 38*a*, so as to collect the residual waste ink removed from printhead wiper 72 as printhead 38*a* is moved by printhead carrier 32 in direction 97. Alternatively, arc-shaped surface 102 may be replaced by another geometric configuration, such as for example, a V-channel.

If bi-directional wiping is performed by printhead wiper 72, the optional printhead wiper cleaning mechanism 84 may be included on body 98 of printhead cartridge 34*a*. The structure, arrangement, and attachment of printhead wiper cleaning mechanism 84 is substantially the same as that described above with respect to printhead wiper cleaning mechanism 82, and thus for brevity will not be repeated here. With this dual structure, the printhead wiper cleaning mechanism 82 including its printhead wiper cleaning blade is spaced apart from printhead wiper cleaning mechanism 84 including its printhead wiper cleaning blade, with printhead 38*a* being located between printhead wiper cleaning mechanism 82 and printhead wiper cleaning mechanism 84. With this arrangement, the arc-shaped surfaces of each of printhead wiper cleaning mechanism 82 and printhead wiper cleaning mechanism 84 face away from printhead 38*a*.

Figure 3:
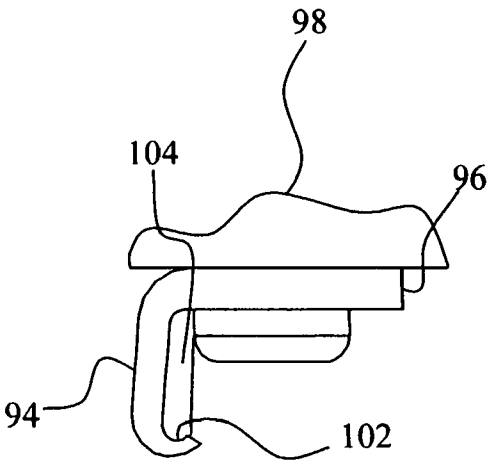
FIG. 3 shows a broken-out portion of the printhead cartridge of FIG. 2, with the addition of a foam member.

FIG. 3 shows an embodiment wherein printhead wiper cleaning mechanism 82, and/or optionally printhead wiper cleaning mechanism 84, may include a foam member 104 that is positioned adjacent arc-shaped surface 102 of hook member 94. Foam member 104 aids in the absorption and retention of the waste ink, such as for example, when the waste ink is in a liquid or solid form.

Figure 4:
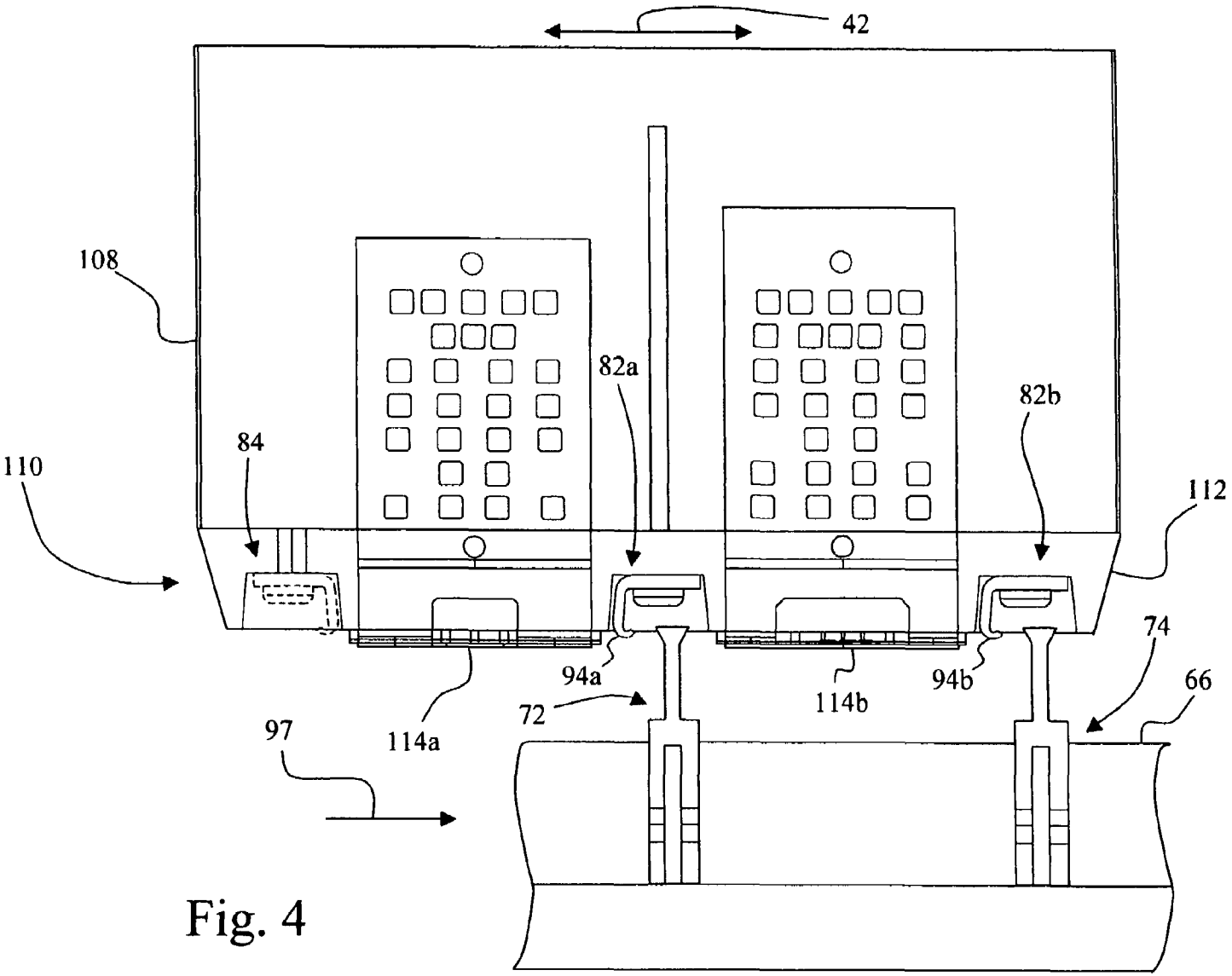
FIG. 4 is an enlarged front view of a printhead carrier with a semi-permanently mounted printhead assembly including a printhead wiper cleaning mechanism, in accordance with another embodiment of the present invention.

FIG. 4 shows another embodiment of the present invention, wherein the printhead carrier 32 of FIG. 1 is replaced with a printhead carrier 108 having a semi-permanently mounted printhead assembly 110. Printhead assembly 110, as depicted in FIG. 4, includes a base 112, a printhead 114*a* and a printhead 114*b*, and two printhead wiper cleaning mechanisms identical to that of printhead wiper cleaning mechanism 82 depicted and described above with respect to FIG. 2, and individually identified as 82*a* and 82*b*. Printhead wiper cleaning mechanism 82*a* includes a curved printhead wiper cleaning blade 94*a*. Printhead wiper cleaning mechanism 82*b* includes a curved printhead wiper cleaning blade 94*b*.

In this embodiment, each of printheads 114*a*, 114*b* and printhead wiper cleaning mechanisms 82*a*, 82*b* is attached to base 112 of printhead assembly 110. Printhead carrier 108 is configured to receive one or more replaceable ink supplies for supplying ink to printheads 114*a*, 114*b*. Printhead wiper cleaning mechanism 82*a* is positioned to clean printhead wiper 72, prior to printhead wiper 72 wiping printhead 114*a*, as printhead carrier 108 travels in direction 97. Printhead wiper cleaning mechanism 82*b* is positioned to clean printhead wiper 74, prior to printhead wiper 74 wiping printhead 114*b*, as printhead carrier 108 travels in direction 97.

Optionally, printhead assembly 110 may include one or more of printhead wiper cleaning mechanisms 84 to facilitate bi-directional cleaning of the respective printhead wiper. The structure, arrangement, and attachment of printhead wiper cleaning mechanisms 82*a*, 82*b* and/or 84 is substantially the same as that described above with respect to FIG. 2, with the exception that the respective printhead wiper cleaning mechanism(s) is/are attached to base 112 of printhead assembly 110, rather than to the body of a printhead cartridge. Also, with this arrangement including a plurality of printheads 114*a*, 114*b*, and a plurality of printhead wiper cleaning blades 94*a*, 94*b*, the printhead wiper cleaning blade 94*a* is positioned between the two consecutive printheads 114*a*, 114*b*.

While the present invention has been described with respect to exemplary embodiments, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a maintenance station mounting a printhead wiper having a waste ink collection surface;

a printhead carrier carrying a printhead and a printhead wiper cleaning mechanism for cleaning said printhead wiper, said printhead wiper cleaning mechanism including a hook member positioned to contact said waste ink collection surface of said printhead wiper for removing residual waste ink from said waste ink collection surface as said printhead wiper cleaning mechanism is moved by said printhead carrier in a first direction relative to said printhead wiper along a main scan path of said printhead carrier prior to said printhead wiper contacting said printhead.

2. The imaging apparatus of claim 1, wherein said printhead wiper includes an elongate body and a wiper head attached to said elongate body, said wiper head including a wiping edge, said waste ink collection surface of said printhead wiper being adjacent said wiping edge.

3. The imaging apparatus of claim 1, wherein said hook member is a curved blade.

4. The imaging apparatus of claim 1, wherein said hook member of said printhead wiper cleaning mechanism has an arc-shaped surface, and further comprising a foam member positioned adjacent said arc-shaped surface.

5. The imaging apparatus of claim 1, comprising a printhead cartridge including said printhead and said printhead wiper cleaning mechanism.

6. The imaging apparatus of claim 5, said printhead cartridge being removably attached to said printhead carrier.

7. The imaging apparatus of claim 1, comprising a printhead assembly including said printhead and said printhead wiper cleaning mechanism.

8. The imaging apparatus of claim 7, said printhead assembly being semi-permanently attached to said printhead carrier.

9. The imaging apparatus of claim 1, said maintenance station comprising a maintenance housing, and a maintenance sled movably mounted to said maintenance housing, said printhead wiper being mounted to said maintenance sled.

10. The imaging apparatus of claim 1, said printhead wiper cleaning mechanism being positioned on one side of said printhead in said first direction of said main scan path.

11. A printhead cartridge removably attachable as a unit to a printhead carrier, comprising:

a body;

at least one printhead coupled to said body; and at least one printhead wiper cleaning blade attached to said body.

12. The printhead cartridge of claim 11, further comprising a foam member positioned adjacent said arc-shaped surface, said foam member absorbing said waste ink.

13. The printhead cartridge of claim 11, wherein said arc-shaped surface faces outwardly from said at least one printhead.

14. A printhead cartridge, comprising:

a body;

a printhead coupled to said body; and a first printhead wiper cleaning blade spaced apart from a second printhead wiper cleaning blade, said printhead being located between said first printhead wiper cleaning blade and said second printhead wiper cleaning blade, said first printhead wiper cleaning blade and said second printhead wiper cleaning blade being substantially the same.

15. A printhead assembly, comprising:

a base;

at least one printhead coupled to said base; and at least one printhead wiper cleaning blade coupled to said base, said wiper cleaning blade having a hook-shaped cleaning surface that faces away from said at least one printhead for receiving waste ink.

16. The printhead assembly of claim 15, wherein said at least one printhead wiper cleaning blade includes an arc-shaped surface for receiving waste ink.

17. The printhead assembly of claim 16, further comprising a foam member positioned adjacent said arc-shaped surface, said foam member absorbing said waste ink.

18. The printhead assembly of claim 15, comprising a first printhead wiper cleaning blade spaced apart from a second printhead wiper cleaning blade, said printhead being located between said first printhead wiper cleaning blade and said second printhead wiper cleaning blade, said first printhead wiper cleaning blade and said second printhead wiper cleaning blade being substantially the same.

19. The printhead assembly of claim 15, comprising a plurality of printheads, and a plurality of printhead wiper cleaning blades, with at least one of said plurality of printhead wiper cleaning blades being positioned between two consecutive printheads of said plurality of printheads.

* * * * *